US006386501B1

(12) United States Patent
McDowell

(10) Patent No.: US 6,386,501 B1
(45) Date of Patent: May 14, 2002

(54) EASY-READ MULTIPURPOSE BOOK PROP

(76) Inventor: Eloise W. McDowell, 5 Founders Ct., Damascus, MD (US) 20872

( * ) Notice: Subject to any disclaimer, the term of this patent is extended or adjusted under 35 U.S.C. 154(b) by 0 days.

(21) Appl. No.: 09/260,134

(22) Filed: Mar. 1, 1999

(51) Int. Cl.[7] ..... A47B 23/04; B42D 17/00
(52) U.S. Cl. ..... 248/454; 248/460; 281/45
(58) Field of Search ..... 248/441.1, 446, 248/454, 455, 460, 461, 444, 457, 451, 453, 459; 281/45

(56) References Cited

U.S. PATENT DOCUMENTS 2,012,551 A * 8/1935 Steen ..... 248/463
3,410,516 A * 11/1968 Criswell ..... 248/463
3,758,065 A * 9/1973 Ranseen ..... 248/463
4,378,102 A * 3/1983 Ports, Jr. et al. ..... 248/460
4,655,478 A * 4/1987 Malyon ..... 248/441.1
5,029,797 A * 7/1991 Levorchick et al. ..... 248/463
5,722,628 A * 3/1998 Menaged ..... 248/441.1
D415,532 S * 10/1999 Tobin ..... D19/91

FOREIGN PATENT DOCUMENTS

DE 255150 * 5/1912 ..... 248/454

* cited by examiner

*Primary Examiner*—Leslie A. Braun
*Assistant Examiner*—Jon A. Szumny

(57) ABSTRACT

A book prop with storage space which is light in weight, collapsable, and allows the angle of repose of a book leaning against it to be varied. The book prop comprises two elongated rigid members joined by a flexible web. In use, the book rests on top of the rear member and the bottom of the book abuts the rear of the front member. The flexible web maintains the distance between the front and rear members. Rolling the flexible web onto the front member shortens the distance between the front and rear members, thereby increasing the angle of repose of a book being supported. The rear member, which is hollow and has an end closure, allows storage of pens, pencils, rolls of paper, etc.

5 Claims, 4 Drawing Sheets

EASY-READ MULTIPURPOSE BOOK PROP

BACKGROUND

When sitting at a desk or table reading a book it is sometimes more comfortable and convenient to have the book resting at angle to the surface of the desk or table than have it lying flat. However, keeping the book at this angle can become tiring to the hands, or, if the reader has arthritis, it can be difficult at best and painful at worst.

For this reason the prior art has developed many book holders designed to hold or prop a book at an angle on a desk or table. Most of these holders comprise some type of collapsible frame made of rigid members hinged together. Such a frame, while effective for its intended purpose, is often either sturdy and therefore heavy and cumbersome to pack and carry, or lightweight and therefore subject to being bent or distorted. Further, such a holder is usually designed to hold/prop a book at only one angle, and can usually accommodate only a limited range of sizes of books.

OBJECTS OF THE INVENTION

Accordingly, it is an object of the present invention to provide a book prop which avoids the problems of the prior art collapsible fame book props.

It is a further object of the present invention to provide such a book prop which occupies a small volume when not in use.

It is a still further object of the present invention to provide such a book prop which has storage space within it for small reading/writing materials, craft supplies, etc.

It is a yet further object of the present invention to provide such a book prop which will accommodate a wide range of sizes and weights of books or other reading materials.

SUMMARY

Briefly, the present invention is a multi-purpose book prop comprising a lidded hollow rear member with end drawers, a front member, and a flexible web joining the two. Both front and rear members are of square or rectangular cross-section, with the front member being of a smaller cross-section than the rear member. Access to the drawers can be achieved either by raising the lids or by sliding the drawers out. The flexible web is attached to three sides of the rear member and the bottom of the front member. When used to support a book the book prop is oriented so that the flexible web slopes down to the front member; the bottom edge of the book abuts the rear of the front member and the book rests against the top of the rear member at a comfortable reading angle. Rolling the front member one or more turns toward the rear member allows the reading matter to sit at an even higher angle. Raising and securing the lids of the rear member will support the reading matter at its highest angle.

DESCRIPTION OF THE PREFERRED EMBODIMENT

Figure 1:
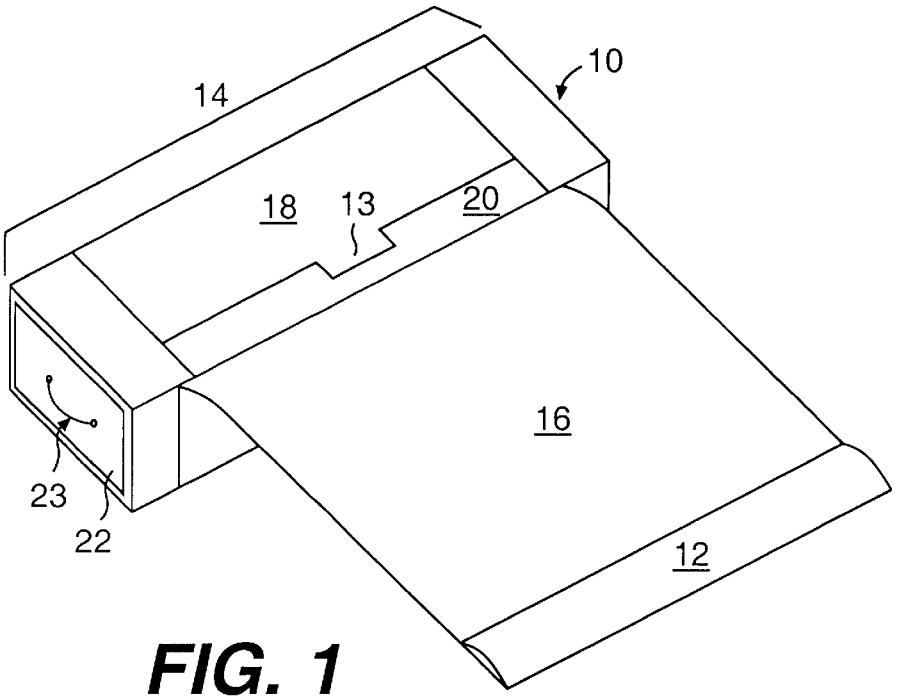
FIG. 1 shows the book prop of the present invention in perspective.

FIG. 1 shows book prop 10 of the present invention. As can be seen, it comprises front member 12 and rear member 14 joined together by flexible web 16. Flexible web 16 is attached to the three unlidded sides of rear member 14, which has a larger cross-section than front member 12 since it primarily determines the angle of repose of a book being supported. If the long dimension of the cross section of member 14 is vertical as in FIG. 2, the angle of repose will be greater than if the short dimension of the cross section of member 14 is vertical, as in FIG. 3. In this manner the angle of repose of the book can be either of two amounts, with finer adjustment possible by rolling front member 12 toward or away from rear member 14.

Front member 12 and rear member 14 are of approximately the same length, which is approximately the same as the width of an average book when it is opened flat However, it has been found that much larger and heavier reading materials can be supported by the prop of the present invention. Thus only one size prop is needed for all sizes and weights of reading material as in FIG. 3.

Figure 2:
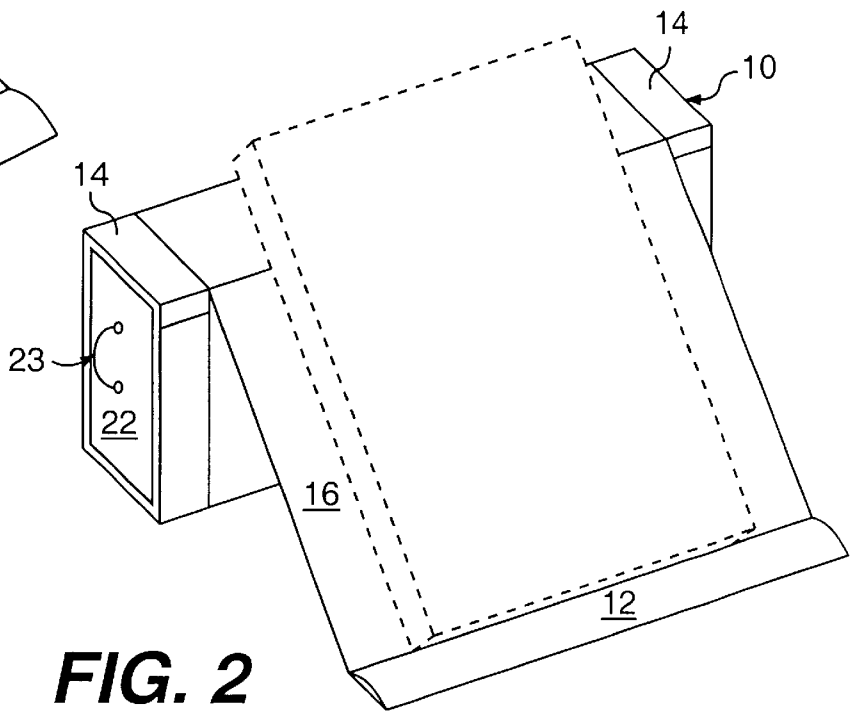
FIGS. 2 and 3 shows the possible variations in angle of the book being supported by the book prop of the present invention when the lids are closed.
Figures 3, 4:
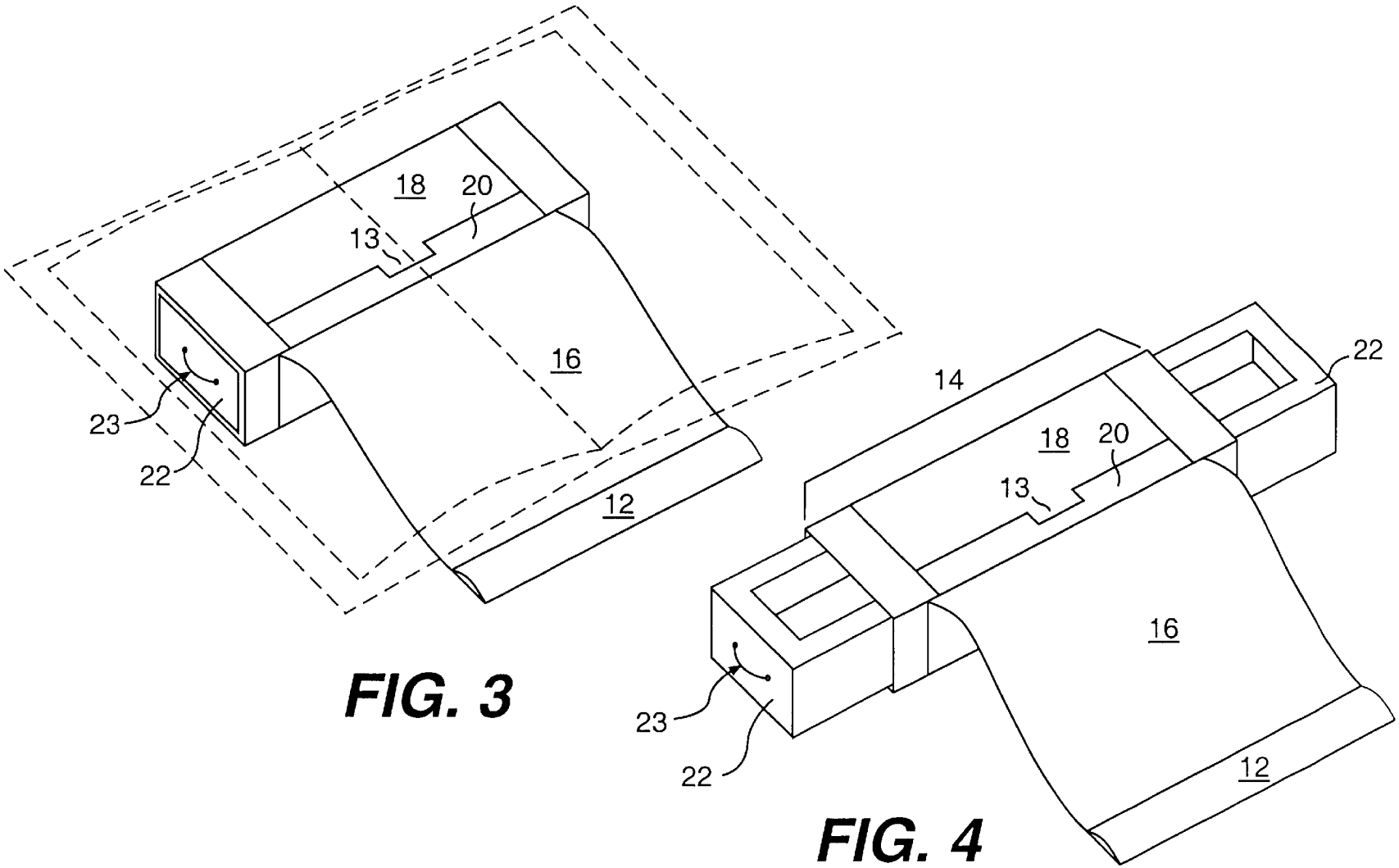
FIG. 4 shows the book prop of the present invention with the end drawers extended.

FIGS. 2 and 3 show the variation in angle of support hat can be achieved with the book prop of the present invention by adjusting the position of front member 12 with respect to rear member 14. Rolling front member 12 an additional half revolution toward tear member 14 would increase the angle still more.

FIG. 4 shows extended end drawers 22 (with pulls 23) positioned to support very wide and flimsy reading matter such as newspapers.

Rear member 14 is hollow in order to contain drawers 22. Lids 18 and 20 provide entry to drawers 22. Lid 20 has loop 21 in slot 15 (FIG. 5) which is grasped in order to raise lid 20, exposing lid 18 which can then be lifted to gain access to the interiors of drawers 22. Pencils, pens, rolled-up pieces of paper, etc. can be stored in drawers 22. Velcro ™ tabs 19 on top of lid 20 in FIG. 5 attach to Velcro™ tab mates (not shown) on the underside of lid 18 to secure the lids together when they are closed.

Figure 5:
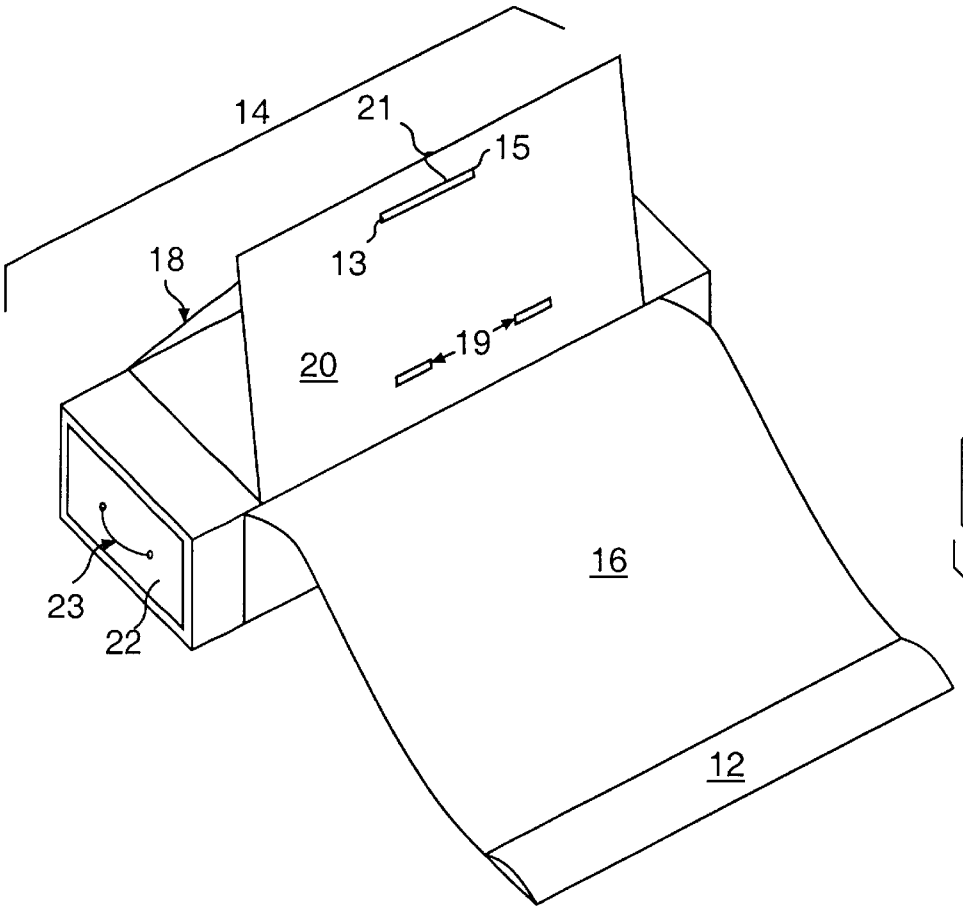
FIG. 5 shows the book prop of the present invention with lids used to support reading matter at greatest height possible.

As shown in FIG. 5, an even greater angle of repose can be achieved by opening lids 18 and 20 and slipping tab 13 into slot 15 to hold lids 18 and 20 in the raised position. Since the bottom edge of a book being supported abuts the rear of front member 12, front member 12 is biased away from rear member 14 but is kept from sliding away from it by the tension in flexible web 16. Rear member 14 is kept in place by the weight of the book being supported. Changing the distance between front member 12 and rear member 14 allows the angle of repose to be adjusted. This, in conjunction with the ability to have either the longer or the shorter cross section dimension of rear mar 14 vertical, allows a larger number of angles of repose of the book being supported without using lids 18 and 20.

Figure 6:
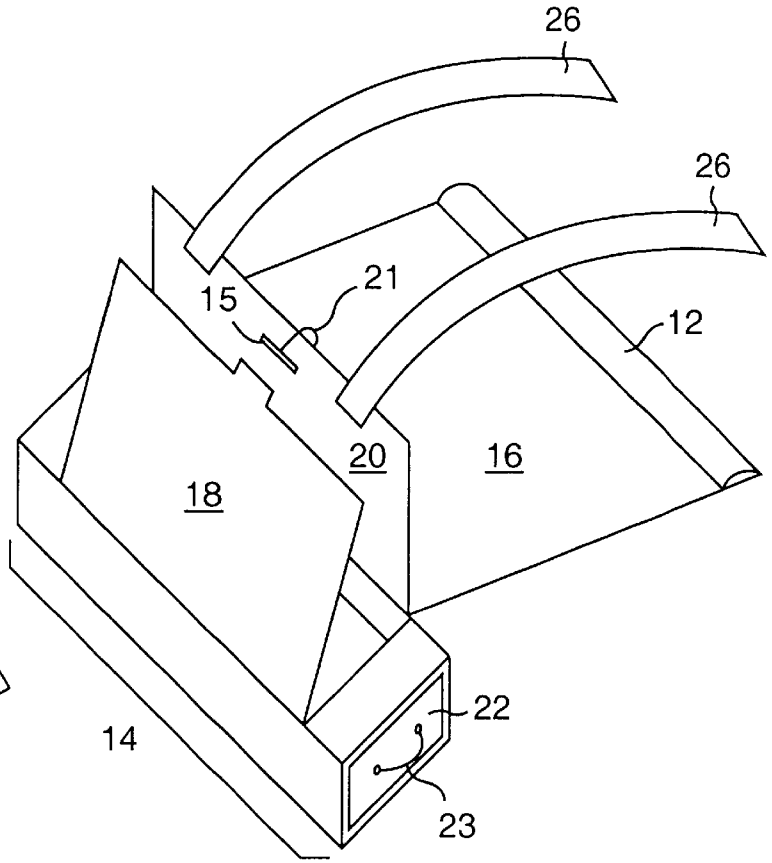
FIG. 6 shows the book prop of the present invention with the clear plastic strips attached.

Book prop 10 also has removable flexible strips 26 (see FIG. 6) which hold the book open at a desired page. Strips 26 fasten to the undersides of lid 20 by a snap, Velcro™, or any other means, and extend over the pages of the book being supported and then are tucked under the book itself or under font member 12, thereby keeping the pages of the book from flipping or being blown by the wind. Obviously strips 26 are preferably made of clear plastic in order to not obscure the printing underneath them. When not in use strips 26 can be detached and stored in rear member 14.

Figure 7:
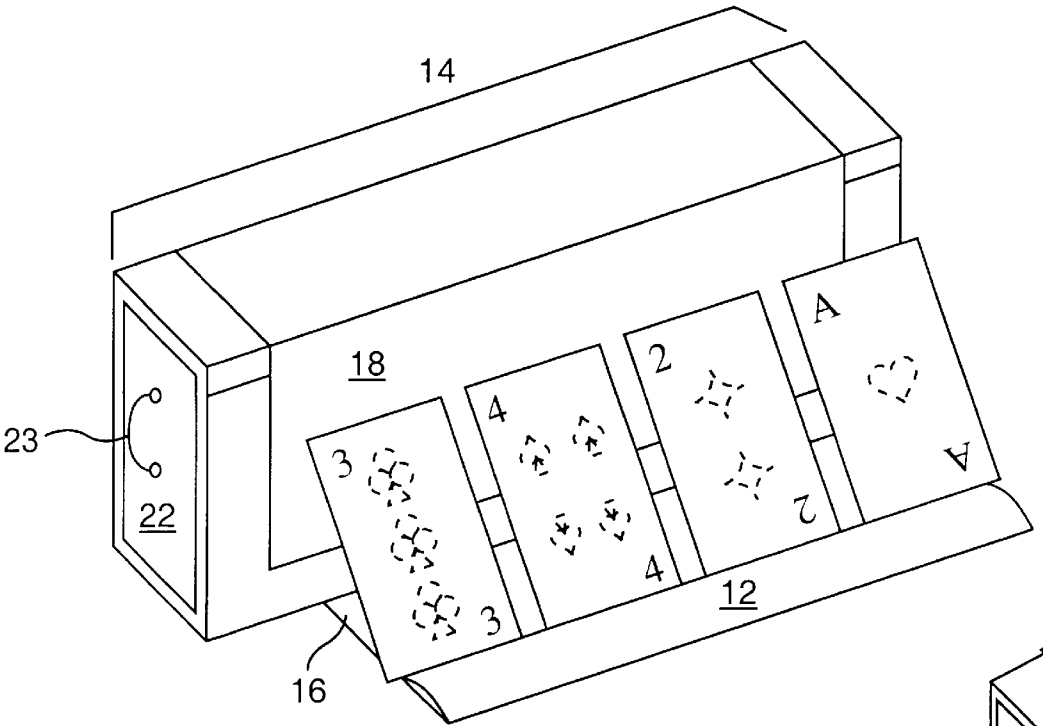
FIG. 7 shows the book prop of the present invention supporting small items such as playing cards.

FIG. 7 shows rear member placed so that flexible web 16 lays flat on the table or desk to support smaller, lightweight objects such as playing cards. This orientation is preferable to that for supporting books, etc. because it more fully shields the cards from one's opponents sitting across the table. This allows a person with the use of only one hand to play bridge or other card games. As with a book, the bottoms of the playing cards abut front member 12 and the playing cards rest against rear member 14. The angle of repose of the cards can be adjusted by the placement of front member 12 with respect to rear member 14.

Front member 12 and rear member 14 can be of any material but are preferably of wood or plastic, which are sturdy but not excessively heavy. Flexible web 16, which should not be of a very stiff material, can be attached to font member 12 and rear member 14 by any means such as gluing or any other suitable means.

Figure 8:
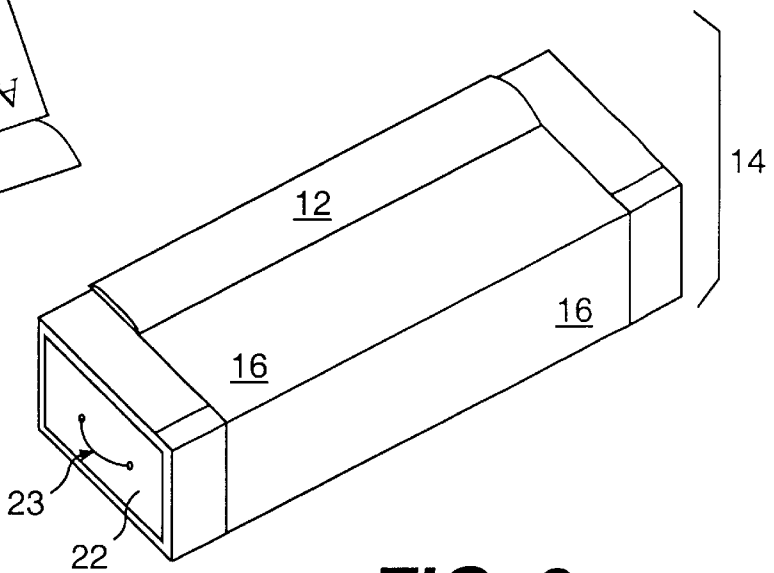
FIG. 8 shows the book prop of the present invention in its most compact form.

FIG. 8 shows book prop 10 in its most compact form when flexible web 16 has been completely rolled onto/around rear member 14 so that front member 12 rests against rear member 14.

I claim:

1. A book prop for use on a horizontal surface comprising:

a) an elongated front member forming an abutment for the front of an average book and having a length and a cross section whereby the length is adapted to be the same as the width of said book when opened flat;

b) an elongated hollow rear member having a length approximately equal to that of said front member and a cross section larger than that of said front member and further including:

i) a plurality of drawers extending substantially lengthwise for supporting wide and flimsy reading matter;

ii) a plurality of lids on a top surface thereof for gaining access to the interior of the drawers with a means for securing said lids together; and c) a flexible web adapted to support said book and joining together said front and rear members along said lengths whereby said web can be completely rolled around said rear member so that said front member rests against said rear member providing a compact form of said book prop.

2. A The book prop as in claim 1, wherein said web is connected to the rear member along three unlidded sides thereof.

3. The book prop as in claim 1, further comprising means for keeping a book supported thereon open at a desired page.

4. The book prop as in claim 1, whereby said front member can be rolled toward or away from said rear member in order to adjust the angle of repose of a book being supported on said book prop.

5. The book prop as in claim 1, whereby playing cards can be supported thereon.

* * * * *